United States Patent [19]

Atal

[11] 4,220,819

[45] Sep. 2, 1980

[54] RESIDUAL EXCITED PREDICTIVE SPEECH CODING SYSTEM

[75] Inventor: Bishnu S. Atal, Murray Hill, N.J.

[73] Assignee: Bell Telephone Laboratories, Incorporated, Murray Hill, N.J.

[21] Appl. No.: 25,731

[22] Filed: Mar. 30, 1979

[51] Int. Cl.[2] ..... G10L 1/00

[52] U.S. Cl. ..... 179/1 SA

[58] Field of Search ..... 179/1 SA, 1 SC, 1 SM

[56] References Cited

U.S. PATENT DOCUMENTS

| | | | |
|---|---|---|---|
| 2,928,902 | 3/1960 | Vilbig | 179/15.55 |
| 3,975,587 | 8/1976 | Dunn et al. | 179/1 SA |
| 3,979,557 | 9/1976 | Schulman et al. | 179/1 SA |
| 4,081,605 | 3/1978 | Kitawaki et al. | 179/1 SC |

OTHER PUBLICATIONS

M. Sambur, et al., "On Reducing the Buzz in LPC Synthesis," J. Ac. Soc. of America, Mar. 1978, pp. 918–924.

*Primary Examiner*—Malcolm A. Morrison
*Assistant Examiner*—E. S. Kemeny
*Attorney, Agent, or Firm*—Jack S. Cubert

[57] ABSTRACT

In a speech processing arrangement for synthesizing more natural sounding speech, a speech signal is partitioned into intervals. For each interval, a set of coded prediction parameter signals, pitch period and voicing signals, and a set of signals corresponding to the spectrum of the prediction error signal are produced. A replica of the speech signal is generated responsive to the coded pitch period and voicing signals as modified by the coded prediction parameter signals. The pitch period and voicing signals are shaped responsive to the prediction error spectral signals to compensate for errors in the predictive parameter signals whereby the speech replica is natural sounding.

10 Claims, 8 Drawing Figures

RESIDUAL EXCITED PREDICTIVE SPEECH CODING SYSTEM

My invention relates to digital speech communication and more particularly to digital speech signal coding and decoding arrangements.

The efficient use of transmission channels is of considerable importance in digital communication systems where channel bandwidth is broad. Consequently, elaborate coding, decoding, and multiplexing arrangements have been devised to minimize the bit rate of each signal applied to the channel. The lowering of signal bit rate permits a reduction of channel bandwith or increase in the number of signals which can be multiplexed on the channel.

Where speech signals are transmitted over a digital channel, channel efficiency can be improved by compressing the speech signal prior to transmission and constructing a replica of the speech from the compressed speech signal after transmission. Speech compression for digital channels removes redundancies in the speech signal so that the essential speech information can be encoded at a reduced bit rate. The speech transmission bit rate may be selected to maintain a desired level of speech quality.

One well known digital speech coding arrangement, disclosed in U.S. Pat. No. 3,624,302 issued Nov. 30, 1971, includes a linear prediction analysis of an input speech signal in which the speech is partitioned into successive intervals and a set of parameter signals representative of the interval speech are generated. These parameter signals comprise a set of linear prediction coefficient signals corresponding to the spectral envelope of the interval speech, and pitch and voicing signals corresponding to the speech excitation. The parameter signals are encoded at a much lower bit rate then required for encoding the speech signal as a whole. The encoded parameter signals are transmitted over a digital channel to a destination at which a replica of the input speech signal is constructed from the parameter signals by synthesis. The synthesizer arrangement includes the generation of an excitation signal from the decoded pitch and voicing signals, and the modification of the excitation signal by the envelope representative prediction coefficients in an all-pole predictive filter.

While the foregoing pitch excited linear predictive coding is very efficient in bit rate reduction, the speech replica from the synthesizer exhibits a synthetic quality unlike the natural human voice. The synthetic quality is generally due to inaccuracies in the generated linear prediction coefficient signals which cause the linear prediction spectral envelope to deviate from the actual spectral envelope of the speech signal and to inaccuracies in the pitch and voicing signals. These inaccuracies appear to result from differences between the human vocal tract and the all pole filter model of the coder and the differences between the human speech excitation apparatus and the pitch period and voicing arrangements of the coder. Improvement in speech quality has heretofore required much more elaborate coding techniques which operate at far greater bit rates than does the pitch excited linear predictive coding scheme. It is an object of the invention to provide natural sounding speech in a digital speech coder at relatively low bit rates.

SUMMARY OF THE INVENTION

Generally, the synthesizer excitation generated during voiced portions of the speech signal is a sequence of pitch period separated impulses. It has been recognized that variations in the excitation pulse shape effects the quality of the synthesized speech replica. A fixed excitation pulse shape, however, does not result in a natural sounding speech replica. But, particular excitation pulse shapes effect an improvement in selected features. I have found that the inaccuracies in linear prediction coefficient signals produced in the predictive analyzer can be corrected by shaping the predictive synthesizer excitation signal to compensate for the errors in the predictive coefficient signals. The resulting coding arrangement provides natural sounding speech signal replicas at bit rates substantially lower than other coding systems such as PCM, or adaptive predictive coding.

The invention is directed to a speech processing arrangement in which a speech analyzer is operative to partition a speech signal into intervals and to generate a set of first signals representative of the prediction parameters of the interval speech signal, and pitch and voicing representative signals. A signal corresponding to the prediction error of the interval is also produced. A speech synthesizer is operative to produce an excitation signal responsive to the pitch and voicing representative signals and to combine the excitation signal with the first signal to construct a replica of the speech signal. The analyzer further includes apparatus for generating a set of second signals representative of the spectrum of the interval predictive error signal. Responsive to the pitch and voicing representative signals and the second signals, a predictive error compensating excitation signal is formed in the synthesizer whereby a natural sounding speech replica is constructed.

According to one aspect of the invention, the prediction error compensating excitation signal is formed by generating a first excitation signal responsive to the pitch and voicing representative signals and shaping the first excitation signal responsive to the second signals.

According to another aspect of the invention, the first excitation signal comprises a sequence of excitation pulses produced jointly responsive to the pitch and voicing representative signals. The excitation pulses are modified responsive to the second signals to form a sequence of prediction error compensating excitation pulses.

According to yet another aspect of the invention, a plurality of prediction error spectral signals are formed responsive to the prediction error signal in the speech analyzer. Each prediction error spectral signal corresponds to a predetermined frequency. The prediction error spectral signals are sampled during each interval to produce the second signals.

According to yet another aspect of the invention, the modified excitation pulses in the speech synthesizer are formed by generating a plurality of excitation spectral component signals corresponding to the predetermined frequencies from the pitch and voicing representative signals and a plurality of prediction error spectral coefficient signals corresponding to the predetermined frequencies from the pitch representative signal and the second signals. The excitation spectral component signals are combined with the prediction error spectral coefficient signals to produce the prediction error compensating excitation pulses.

DETAILED DESCRIPTION

Figure 1:
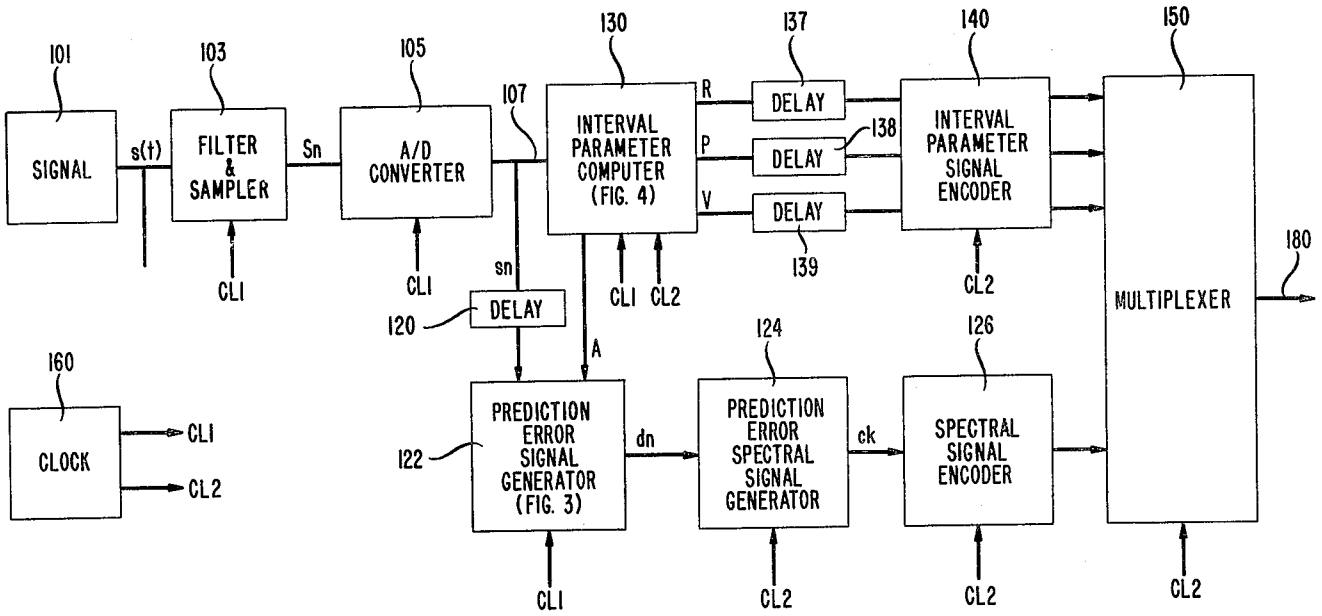
FIG. 1 depicts a block diagram of a speech signal encoder circuit illustrative of the invention.

A speech signal encoder circuit illustrative of the invention is shown in FIG. 1. Referring to FIG. 1, a speech signal is generated in speech signal source 101 which may comprise a microphone, a telephone set or other electroacoustic transducer. The speech signal s(t) from speech signal source 101 is supplied to filter and sampler circuit 103 wherein signal s(t) is filtered and sampled at a predetermined rate. Circuit 103, for example, may comprise a lowpass filter with a cutoff frequency of 4 kHz and a sampler having a sampling rate of at least 8 kHz. The sequence of signal samples, $S_n$ are applied to analog-to-digital converter 105 wherein each sample is converted into a digital code $s_n$ suitable for use in the encoder. A/D converter 105 is also operative to partition the coded signal samples into successive time intervals or frames of 10 ms duration.

The signal samples $s_n$ from A/D converter 105 are supplied to the input of prediction error signal generator 122 via delay 120 and to the input of interval parameter computer 130 via line 107. Parameter computer 130 is operative to form a set of signals that characterize the input speech but can be transmitted at a substantially lower bit rate than the speech signal itself. The reduction in bit rate is obtained because speech is quasi-stationary in nature over intervals of 10 to 20 milliseconds. For each interval in this range, a single set of signals can be generated which signals represent the information content of the interval speech. The speech representative signals, as is well known in the art, may include a set of prediction coefficient signals and pitch and voicing representative signals. The prediction coefficient signals characterize the vocal tract during the speech interval while the pitch and voicing signals characterize the glottal pulse excitation for the vocal tract.

Figure 4:
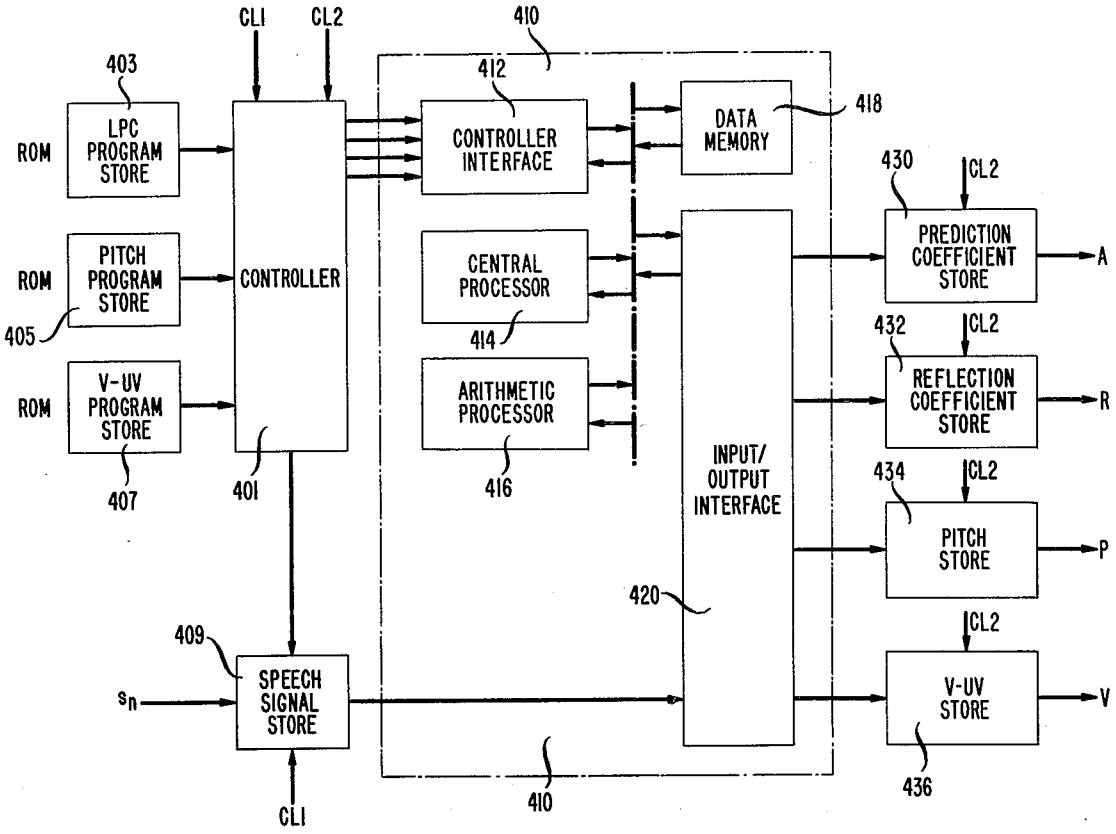
FIG. 4 shows a block diagram of a speech interval parameter computer useful in the circuit of FIG. 1.

Interval parameter computer 130 is shown in greater detail in FIG. 4. The circuit of FIG. 4 includes controller 401 and processor 410. Processor 410 is adapted to receive the speech samples $s_n$ of each successive interval and to generate a set of linear prediction coefficient signals, a set of reflection coefficient signals, a pitch representative signal and a voicing representative signal responsive to the interval speech samples. The generated signals are stored in stores 430, 432, 434 and 436, respectively. Processor 410 may be the CSP Incorporated Macro-Arithmetic Processor system 100 or may comprise other processor or microprocessor arrangements well known in the art. The operation of processor 410 is controlled by the permanently stored program information from read only memories 403, 405 and 407.

Figure 8:
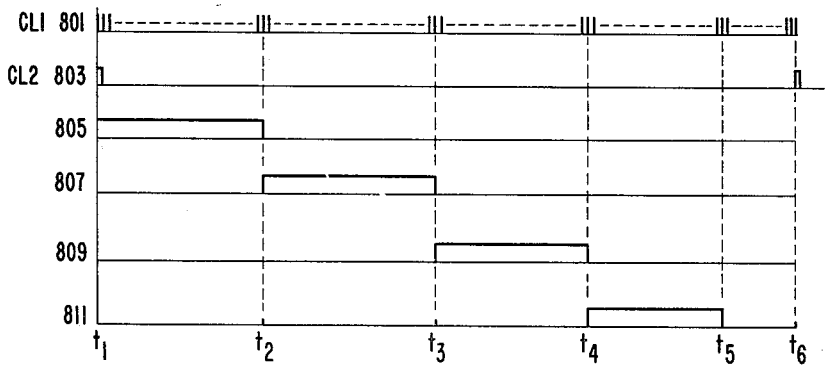
FIG. 8 shows waveforms illustrating the operation of the speech interval parameter computer of FIG. 4.

Controller 401 of FIG. 4 is adapted to partition each 10 millisecond speech interval into a sequence of at least four predetermined time periods. Each time period is dedicated to a particular operating mode. The operating mode sequence is illustrated in the waveforms of FIG. 8. Waveform 801 in FIG. 8 shows clock pulses CL1 which occur at the sampling rate. Waveform 803 in FIG. 8 shows clock pulses CL2, which pulses occur at the beginning of each speech interval. The CL2 clock pulse occurring at time $t_1$ places controller 401 in its data input mode, as illustrated in waveform 805. During the data input mode controller 401 is connected to processor 410 and to speech signal store 409. Responsive to control signals from controller 401, the 80 sample codes inserted into speech signal store 409 during the preceding 10 millisecond speech interval are transferred to data memory 418 via input/output interface circuit 420. While the stored 80 samples of the preceding speech interval are transferred into data memory 418, the present speech interval samples are inserted into speech signal store 409 via line 107.

Upon completion of the transfer of the preceding interval samples into data memory 418, controller 401 switches to its prediction coefficient generation mode responsive to the CL1 clock pulse at time $t_2$. Between times $t_2$ and $t_3$, controller 401 is connected to LPC program store 403 and to central processor 414 and arithmetic processor 416 via controller interface 412. In this manner, LPC program store 403 is connected to processor 410. Responsive to the permanently stored instructions in read only memory 403, processor 410 is operative to generate partial correlation coefficient signals $R=r_1, r_2, \ldots, r_{12}$, and linear prediction coefficient signals $A=a_1, a_2 \ldots, a_{12}$. As is well known in the art, the partial correlation coefficient is the negative of the reflection coefficient. Signals R and A are transferred from processor 410 to stores 432 and 430, respectively, via input/output interface 420. The stored instructions for the generation of the reflection coefficient and linear prediction coefficient signals in ROM 403 are listed in Fortran language in Appendix 1.

As is well known in the art, the reflection coefficient signals R are generated by first forming the co-variance matrix P whose terms are $$P_{ij} = \sum_{n=1}^{80} s_{n-i}s_{n-j} \quad \begin{matrix} i = 1,2,\ldots,12 \\ j = 1,2,\ldots,12 \end{matrix} \tag{1}$$

and speech correlation factors $$C_i = \sum_{n=1}^{80} s_n s_{n-i} \quad i = 1,2,\ldots,12 \tag{2}$$

Factors $g_1$ through $g_{10}$ are then computed in accordance with $$T\begin{bmatrix} g_1 \\ g_2 \\ \cdot \\ \cdot \\ \cdot \\ g_{12} \end{bmatrix} = \begin{bmatrix} C_1 \\ c_2 \\ \cdot \\ \cdot \\ \cdot \\ c_{12} \end{bmatrix} \tag{3}$$

where T is the lower triangular matrix obtained by the triangular decomposition of $$[P_{ij}] = T\,T^{-1} \tag{4}$$

the partial correlation coefficients are then generated in accordance with the $$r_m = \frac{g_m}{[c_o - \sum_{n=1}^{80} g_i]^{\frac{1}{2}}} \quad m = 1,2,\ldots,12 \tag{5}$$

$$c_o = \sum_{n=1}^{80} s_n^2$$

$c_0$ corresponds to the energy of the speech signal in the 10 millisecond interval. Linear prediction coefficient signals $A = a_1, a_2, \ldots, a_{12}$, are computed from the partial correlation coefficient signals $r_m$ in accordance with the recursive formulation $$a_i(m) = a_i(m-1) + r_m a_{m-1}(m-1) \tag{6}$$
$$a_o(o) = 1;\ i = 1,2,\ldots,m-1$$
$$j = 1,2,\ldots,12$$

The partial correlation coefficient signals R and the linear prediction coefficient signals A generated in processor 410 during the linear prediction coefficient generation mode are transferred from data memory 418 to stores 430 and 432 for subsequent use.

After the partial correlation coefficient signals R and the linear prediction coefficient signals A are placed in stores 430 and 432 (by time $t_3$), the linear prediction coefficient generation mode is ended and the pitch period signal generation mode is started. At this time, controller 401 is switched to its pitch mode as indicated in waveform 809. In this mode, pitch program store 405 is connected to controller interface 412 of processor 410. Processor 410 is then controlled by the permanently stored instructions of ROM 405 so that a pitch representative signal for the preceding speech interval is produced responsive to the speech samples in data memory 418 corresponding to the preceding speech interval. The permanently stored instructions of ROM 405 are listed in Fortran language in Appendix 2. The pitch representative signal produced by the operations of central processor 414 and arithmetic processor 416 are transferred from data memory 418 to pitch signal store 434 via input/output interface 420. By time $t_4$, the pitch representative signal is inserted into store 434 and the pitch period mode is terminated.

At time $t_4$, controller 401 is switched from its pitch period mode to its voicing mode as indicated in waveform 811. Between times $t_4$ and $t_5$, ROM 407 is connected to processor 410. ROM 407 contains permanently stored signals corresponding to a sequence of control instructions for determining the voicing character of the preceding speech interval from an analysis of the speech samples of that interval. The permanently stored program of ROM 407 is listed in Fortran language in Appendix 3. Responsive to the instructions of ROM 407, processor 410 is operative to analyze the speech samples of the preceding interval in accordance with the disclosure of the article "A Pattern-Recognition Approach to Voiced-Unvoiced-Silence Classification With Applications to Speech Recognition" by B. S. Atal and L. R. Rabiner appearing in the *IEEE Transactions on Acoustics, Speech, and Signal Processing,* Vol. ASSP-24, No. 3, June 1976. A signal V is then generated in arithmetic processor 416 which characterizes the speech interval as a voiced interval or as an unvoiced interval. The resulting voicing signal is placed in data memory 418 and is transferred therefrom to voicing signal store 436 via input/output interface 420 by time $t_5$. Controller 401 disconnects ROM 407 from processor 410 at time $t_5$ and the voicing signal generation mode is terminated as indicated in waveform 811.

Figure 2:
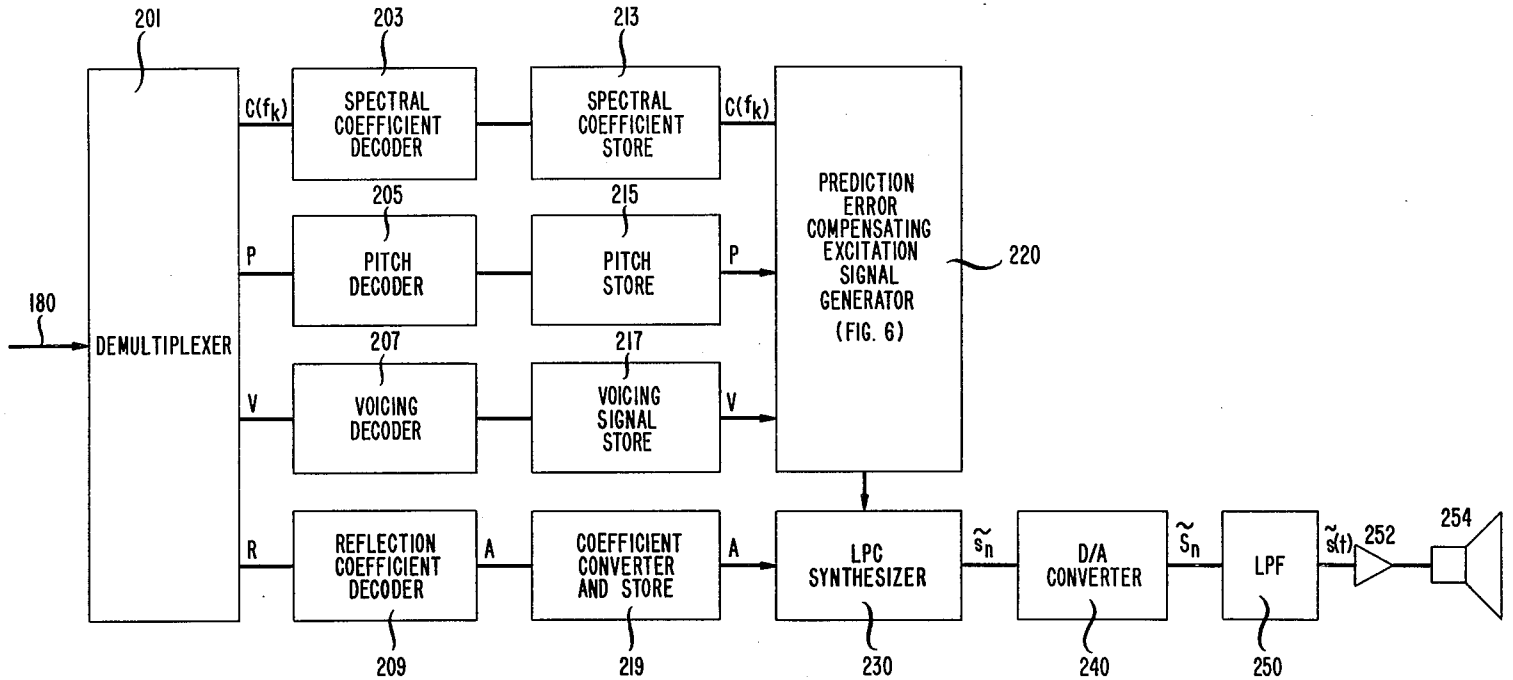
FIG. 2 depicts a block diagram of a speech signal decoder circuit illustrative of the invention.

The reflection coefficient signals R and the pitch and voicing representative signals P and V from stores 432, 434 and 436 are applied to parameter signal encoder 140 in FIG. 1 via delays 137, 138 and 139 responsive to the CL2 clock pulse occurring at time $t_6$. While a replica of the input speech can be synthesized from the reflection coefficient, pitch and voicing signals obtained from parameter computer 130, the resulting speech does not have the natural characteristics of a human voice. The artificial character of the speech derived from the reflection coefficient and pitch and voicing signals of computer 130 is primarily the result of errors in the predictive reflection coefficients generated in parameter computer 130. In accordance with the invention, these errors in prediction coefficients are detected in prediction error signal generator 122. Signals representative of the spectrum of the prediction error for each interval are produced and encoded in prediction error spectral signal generator 124 and spectral signal encoder 126, respectively. The encoder spectral signals are multiplexed together with the reflection coefficient, pitch, and voicing signals from parameter encoder 140 in multiplexer 150. The inclusion of the prediction error spectral signals in the coded signal output of the speech encoder of FIG. 1 for each speech interval permits compensation for the errors in the linear predictive parameters during decoding in the speech decoder of FIG. 2. The resulting speech replica from the decoder of FIG. 2 is natural sounding.

Figure 3:
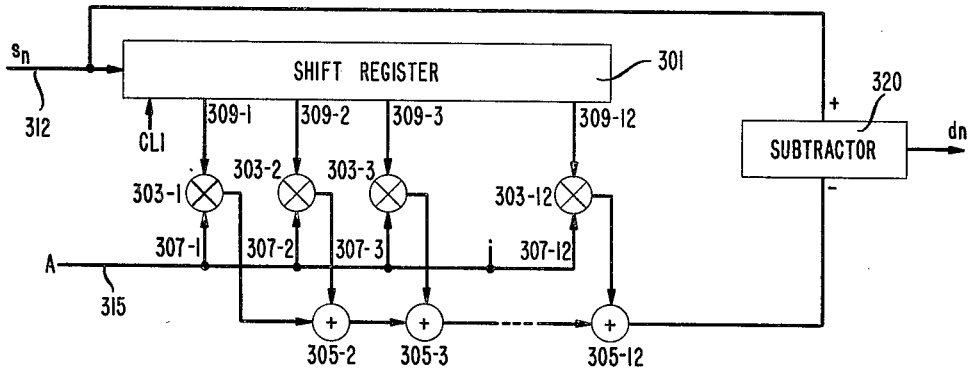
FIG. 3 shows a block diagram of a predictive error signal generator useful in the circuit of FIG. 1.

The prediction error signal is produced in generator 122, shown in greater detail in FIG. 3. In the circuit of FIG. 3, the signal samples from A/D converter 105 are received on line 312 after the signal samples have been delayed for one speech interval in delay 120. The delayed signal samples are supplied to shift register 301 which is operative to shift the incoming samples at the CL1 clock rate of 8 kilohertz. Each stage of shift register 301 provides an output to one of multipliers 303-1 through 303-12. The linear prediction coefficient signals for the interval $a_1, a_2, \ldots, a_{12}$ corresponding to the samples being applied to shift register 301 are supplied to multipliers 303-1 through 303-12 from store 430 via line 315. The outputs of multipliers 303-1 through 303-12 are summed in adders 305-2 through 305-12 so that the output of adder 305-12 is the predicted speech signal $$\hat{s}_n = \sum_{i=1}^{12} a_i s_{n-i} \tag{7}$$

Subtractor 320 receives the successive speech signal samples $s_n$ from line 312 and the predicted value for the successive speech samples from the output of adder 305-12 and provides a difference signal $d_n$ that corresponds to the prediction error.

Figure 5:
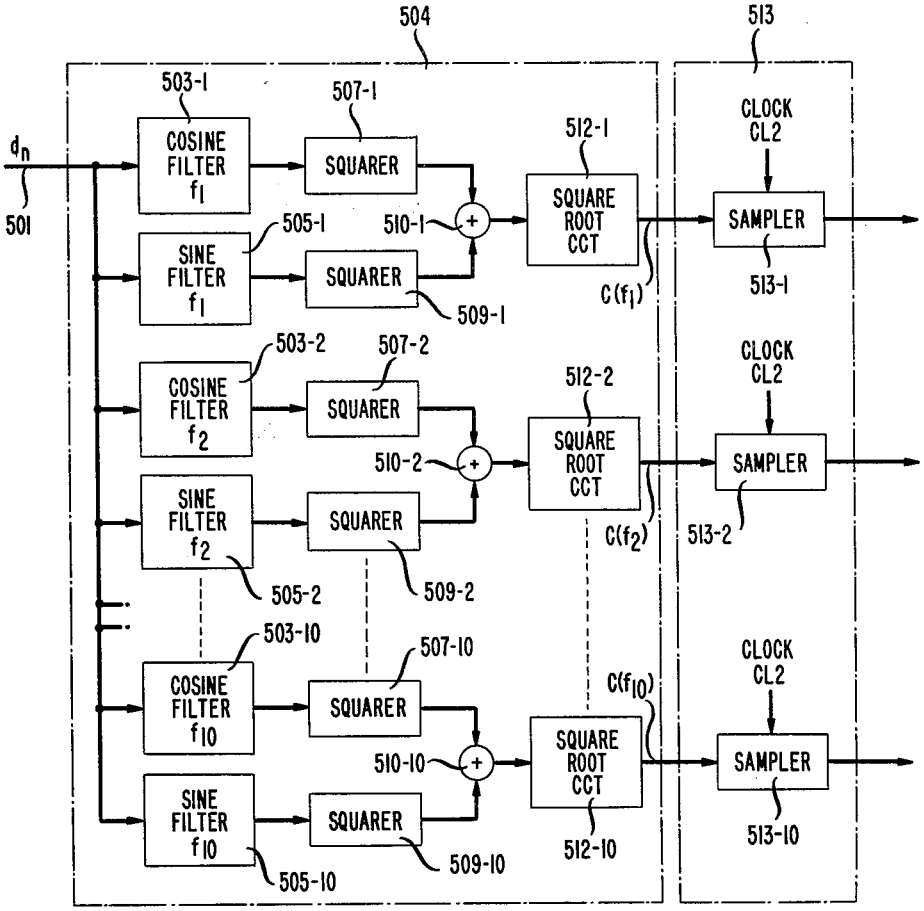
FIG. 5 shows a block diagram of a prediction error spectral signal computer useful in the circuit of FIG. 1.

The sequence of prediction error signals for each speech interval is applied to prediction error spectral signal generator 124 from subtractor 320. Spectral signal generator 124 is shown in greater detail in FIG. 5 and comprises spectral analyzer 504 and spectral sampler 513. Responsive to each prediction error sample $d_n$ on line 501 spectral analyzer 504 provides a set of 10 signals, $c(f_1), c(f_2), \ldots c(f_{10})$. Each of these signals is representative of a spectral component of the prediction error signal. The spectral component frequencies $f_1$, $f_2$, . . . , $f_{10}$ are predetermined and fixed. These predetermined frequencies are selected to cover the frequency range of the speech signal in a uniform manner. For each predetermined frequency $f_i$, the sequence of prediction error signal samples $d_n$ of the speech interval are applied to the input of a cosine filter having a center frequency $f_k$ and an impulse response $h_k$ given by $$h_k=(2/0.54)\ (0.54-0.46\cos 2\pi f_o kT)\ \mathrm{Cos} f_i kT \quad (8)$$

when

T ≡ sampling interval = 125 μsec $f_o$ ≡ frequency spacing of filter center frequencies = 300 Hz k = 0, 1, . . , 26 and to the input of a sine filter of the same center frequency having an impulse response $h'_k$ given by $$h'_k=(2/0.54)\ (0.54-0.46\cos 2\pi f_o kT)\sin f_i kT \quad (9)$$

Cosine filter 503-1 and sine filter 505-1 each has the same center frequency $f_1$ which may be 300 Hz. Cosine filter 503-2 and sine filter 505-2 each has a common center frequency of $f_2$ which may be 600 Hz., and cosine filter 503-10 and sine filter 505-10 each have a center frequency of $f_{10}$ which may be 3000 Hz.

The output signal from cosine filter 503-1 is multiplied by itself is squarer circuit 507-1 while the output signal from sine filter 505-1 is similarly multiplied by itself in squarer circuit 509-1. The sum of the squared signals from circuits 507-1 and 509-1 is formed in adder 510-1 and square root circuit 512-1 is operative to produce the spectral component signal corresponding to frequency $f_1$. In like manner, filters 503-2, 505-2, squarer circuits 507-2 and 509-2, adder circuit 510-2 and square root circuit 512-2 cooperate to form the spectral component $c(f_2)$ corresponding to frequency $f_2$. Similarly, the spectral component signal of predetermined frequency $f_{10}$ is obtained from square root circuit 512-10. The prediction error spectral signals from the outputs of square root circuits 512-1 through 512-10 are supplied to sampler circuits 513-1 through 513-10, respectively.

In each sampler circuit, the prediction error spectral signal is sampled at the end of each speech interval by clock signal CL2 and stored therein. The set of prediction error spectral signals from samplers 513-1 through 513-10 are applied in parallel to spectral signal encoder 126, the output of which is transferred to multiplexer 150. In this manner, multiplexer 150 receives encoded reflection coefficient signals R and pitch and voicing signals P and V for each speech interval from parameter signal encoder 140 and also receives the coded prediction error spectral signals $c(f_n)$ for the same interval from spectral signal encoder 126. The signals applied to multiplexer 150 define the speech of each interval in terms of a multiplexed combination of parameter signals. The multiplexed parameter signals are transmitted over channel 180 at a much lower bit rate than the coded 8 kHz speech signal samples from which the parameter signals were derived.

The multiplexed coded parameter signals from communication channel 180 are applied to the speech decoder circuit of FIG. 2 wherein a replica of the speech signal from speech source 101 is contructed by synthesis. Communication channel 180 is connected to the input of demultiplexer 201 which is operative to separate the coded parameter signals of each speech interval. The coded prediction error spectral signals of the interval are supplied to decoder 203. The coded pitch representative signal is supplied to decoder 205. The coded voicing signal for the interval is supplied to decoder 207, and the coded reflection coefficient signals of the interval are supplied to decoder 209.

The spectral signals from decoder 203, the pitch representative signal from decoder 205, and the voicing representative signal from decoder 207 are stored in stores 213, 215 and 217, respectively. The outputs of these stores are then combined in excitation signal generator 220 which supplies a prediction error compensating excitation signal to the input of linear prediction coefficient synthesizer 230. The synthesizer receives linear prediction coefficient signals $a_1$, $a_2$, . . . $a_{12}$ from coefficient converter and store 219, which coefficients are derived from the reflection coefficient signals of decoder 209.

Figure 6:
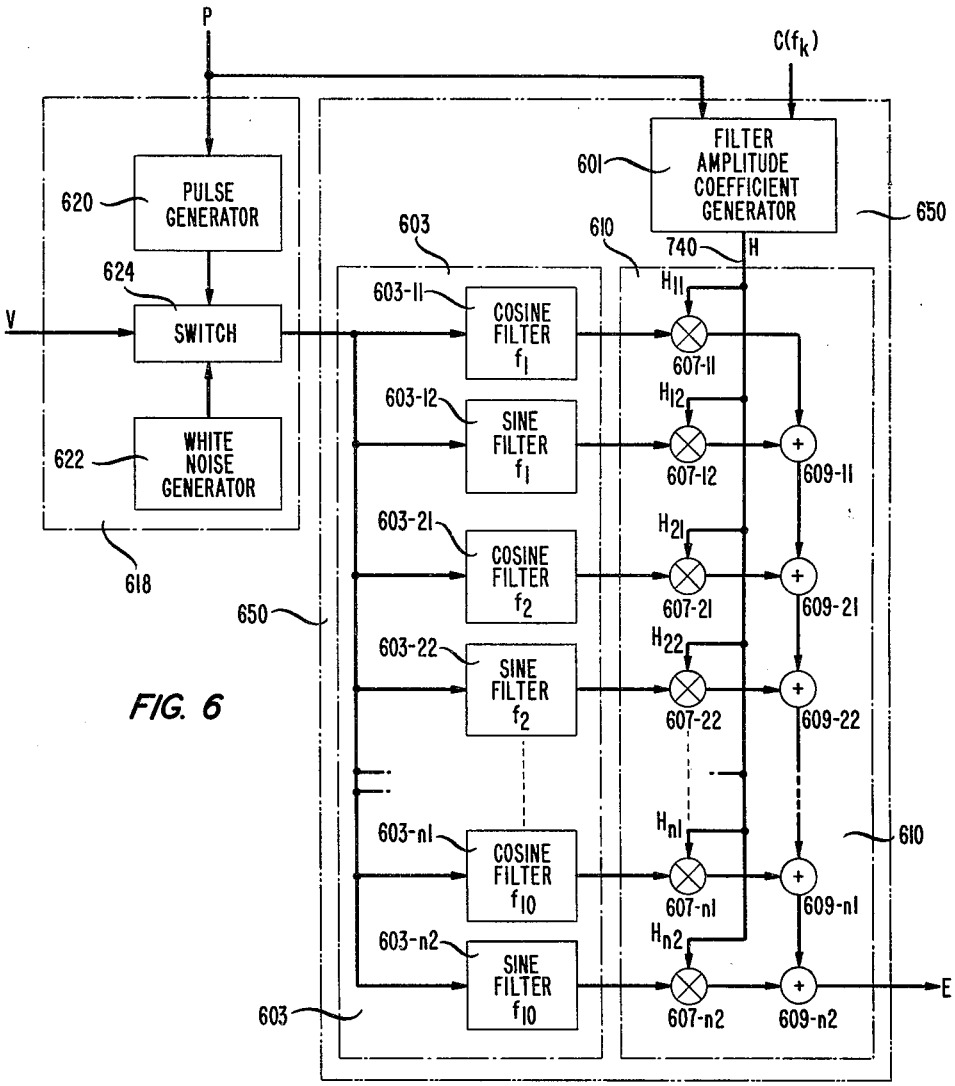
FIG. 6 shows a block diagram of a speech signal excitation generator useful in the circuit of FIG. 2.

Excitation signal generator 220 is shown in greater detail in FIG. 6. The circuit of FIG. 6 includes excitation pulse generator 618 and excitation pulse shaper 650. The excitation pulse generator receives the pitch representative signals from store 215, which signals are applied to pulse generator 620. Responsive to the pitch representative signal, pulse generator 620 provides a sequence of uniform pulses. These uniform pulses are separated by the pitch periods defined by pitch representative signal from store 215. The output of pulse generator 620 is supplied to switch 624 which also receives the output of white noise generator 622. Switch 624 is responsive to the voicing representative signal from store 217. In the event that the voicing representative signal is in a state corresponding to a voiced interval, the output of pulse generator 620 is connected to the input of excitation shaping circuit 650. Where the voicing representative signal indicates an unvoiced interval, switch 624 connects the output of white noise generator 622 to the input of excitation shaping circuit 650.

The excitation signal from switch 624 is applied to spectral component generator 603 which generator includes a pair of filters for each predetermined frequency $f_1$, $f_2$, . . . , $f_{10}$. The filter pair includes a cosine filter having a characteristic in accordance with equation 8 and a sine filter having a characteristic in accordance with equation 9. Cosine filter 603-11 and 603-12 provide spectral component signals for predetermined frequency $f_1$. In like manner, cosine filter 603-21 and sine filter 603-22 provide the spectral component signals for frequency $f_2$ and, similarly, cosine filter 603-n1 and sine filter 603-n2 provide the spectral components for predetermined frequency $f_{10}$.

Figure 7:
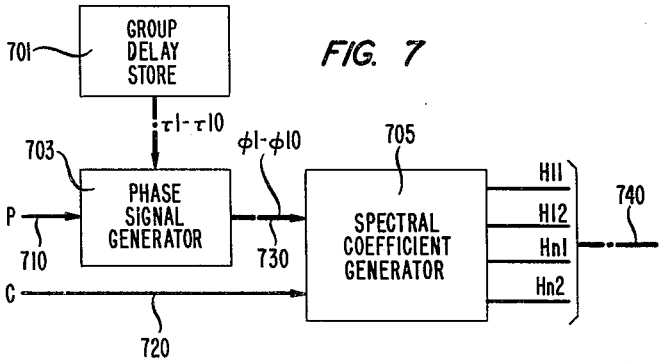
FIG. 7 shows a detailed block diagram of the prediction error spectral coefficient generator of FIG. 2.

The prediction error spectral signals from the speech encoding circuit of FIG. 1 are supplied to filter amplitude coefficient generator 601 together with the pitch representative signal from the encoder. Circuit 601, shown in detail in FIG. 7, is operative to produce a set of spectral coefficient signals for each speech interval. These spectral coefficient signals define the spectrum of the prediction error signal for the speech interval. Circuit 610 is operative to combine the spectral component signals from spectral component generator 603 with the spectral coefficient signals from coefficient generator 601. The combined signal from circuit 610 is a sequence of prediction error compensating excitation pulses that are applied to synthesizer circuit 230.

The coefficient generator circuit of FIG. 7 includes group delay store 701, phase signal generator 703, and spectral coefficient generator 705. Group delay store 701 is adapted to store a set of predetermined delay times $\tau_1, \tau_2, \ldots \tau_{10}$. These delays are selected experimentally from an analysis of representative utterances. The delays correspond to a median group delay characteristic of a representative utterance which has also been found to work equally well for other utterances.

Phase signal generator 703 is adapted to generate a group of phase signals $\Phi_1, \Phi_2, \ldots, \Phi_{10}$ in accordance with $$\Phi_i = (\tau_i/P) \quad i = 1,2,\ldots,10 \tag{10}$$

responsive to the pitch representative signal from line 710 and the group delay signals $\tau_1, \tau_2, \ldots, \tau_{10}$ from store 701. As is evident from equation 10, the phases for the spectral coefficient signals are a function of the group delay signals and the pitch period signal from the speech encoder of FIG. 1. The phase signals $\Phi_1, \Phi_2, \ldots, \Phi_{10}$ are applied to spectral coefficient generator 705 via line 730. Coefficient generator 705 also receives the prediction error spectral signals from store 213 via line 720. A spectral coefficient signal is formed for each predetermined frequency in generator 705 in accordance with $$H_{i,1} = C(f_i) \cos \phi_i \quad i = 1,2,\ldots,10 \tag{11}$$
and
$$H_{i,2} = C(f_i) \sin \phi_i$$

As is evident from equations 10 and 11, phase signal generator 703 and spectral coefficient generator 705 may comprise arithmetic circuits well known in the art.

Outputs of spectral coefficient generator 705 are applied to combining circuit 610 via line 740. In circuit 610, the spectral component signal from cosine filter 603-11 is multiplied by the spectral coefficient signal $H_{1,1}$ in multiplier 607-11 while the spectral component signal from sine filter 603-12 is multiplied by the $H_{1,2}$ spectral coefficient signal in multiplier 607-12. In like manner, multiplier 607-21 is operative to combine the spectral component signal from cosine filter 603-21 and the $H_{2,1}$ spectral coefficient signal from circuit 601 while multiplier 607-22 is operative to combine the spectral component signal from sine filter 603-22 and the $H_{2,2}$ spectral coefficient signal. Similarly, the spectral component and spectral coefficient signals of predetermined frquency $f_{10}$ are combined in multipliers 607-n1 and 607-n2. The outputs of the multipliers in circuit 610 are applied to adder circuits 609-11 through 609-n2 so that the cumulative sum of all multipliers is formed and made available on lead 670. The signal on the 670 may be represented by $$e_n(t) = \sum_{k=1}^{10} C(f_k) \cos (2\pi f_k t - \phi_k) \tag{12}$$

where $C(f_k)$ represents the amplitude of each predetermined frequency component, $f_k$ is the predetermined frequency of the cosine and sine filters, and $\Phi_k$ is the phase of the predetermined frequency component in accordance with equation 10. The excitation signal of equation 12 is a function of the prediction error of the speech interval from which it is derived, and is effective to compensate for errors in the linear prediction coefficients applied to synthesizer 230 during the corresponding speech interval.

LPC synthesizer 230 may comprise an all-pole filter circuit arrangement well known in the art to perform LPC synthesis as described in the article "Speech Analysis and Synthesis by Linear Prediction of the Speech Wave" by B. S. Atal and S. L. Hanauer appearing in the *Journal of the Acoustical Society of America,* Vol. 50 pt 2, pages 637–655, August 1971. Jointly responsive to the prediction error compensating excitation pulses and the linear prediction coefficients for the successive speech intervals, synthesizer 230 produces a sequence of coded speech signal samples $\tilde{s}_n$, which samples are applied to the input of the D/A converter 240. D/A converter 240 is operative to produce a sampled signal $\tilde{S}_n$ which is a replica of the speech signal applied to the speech encoder circuit of FIG. 1. The sampled signal from converter 240 is lowpass filtered in filter 250 and the analog replica output $\tilde{s}(t)$ filter 250 is available from loudspeaker device 254 after amplification in amplifier 252.

APPENDIX 1

```
      GENERATE LPC PARAMETERS - MAIN SUBROUTINE
      PROGRAM NEEDS INPROD

SUBROUTINE LPCPAR

COMMON/BLKSIG/S(320),SP(80)
COMMON/BLKPAR/LPEAK,RMS,VUV,R(10),A(10),PS,PE
COMMON/BLKSCR/P(10,10),T(10,10),C(10),Q(10),W(10)

      S(1) ........ S(320) ARE SPEECH SAMPLES
      S(151) ........ S(160) ARE SAMPLES FROM
      THE PREVIOUS FRAME
      S(161) ....... S (240) ARE SAMPLES FROM
      THE CURRENT FRAME

      COMPUTE ENERGY OF SPEECH SAMPLES
         ENERGY = PS
CALL INPROD(S(161),S(161),80,PS)
```

```
        GENERATE SPEECH CORRELATION
        COEFFICIENTS C(1) .... C(10)
    DO 1 I = 1, 10
  1 CALL INPROD(S(161),S(161-I),80,C(I))

        GENERATE PARTIAL CORRELATIONS
        AND PREDICTOR COEFFICIENTS
    EE=PS
    DO 100 I = 1, 10

        GENERATE COVARIANCE MATRIX ELEMENTS P(I,J)
    DO 20 J = I, 10
    XX = 0.0
    IF (I .EQ. 1 .AND. I .EQ. J) XX = PS
    IF (I .EQ. 1 .AND. J .GT. 1) XX = C(J-1)
    IF (I .GT. 1) XX = P(I-1,J-1)
 20 P(I,J) = XX + S(161-I)*S(161-J) - S(241-I)*S(241-J)

        CONVERT TO TRIANGULAR MATRIX T
        WHERE P = T*T (TRANSPOSE)
    DO 40 J = 1,I
    SM = P(J,I)
    K = 1
  3 IF (K .EQ. J) GO TO 4
     SM = SM - T(I,K)*T(J,K)
     K = K + 1
     GO TO 3

  4 IF (I .EQ. J) W(J) = 1/SQRT(SM)
    IF (I.NE.J) T(I,J) = SM*W(J)
 40 CONTINUE

        GENERATE PARTIAL CORRELATION R(I)
    SM = C(I)
    IF (I .EQ. 1) GO TO 5
    DO 50 J = 2,I
 50 SM = SM - T(I,J-1)*Q(J-1)
  5 Q(I) = SM*W(I)
    IF (I .EQ. 1) GO TO 80
    EE = EE - Q(I-1)*Q(I-1)
 80 R(I) = -Q(I)/SQRT(EE)

        GENERATE PREDICTOR COEFFICIENTS A(1) ... A(I)
   A(I) = R(I)
   IF (I .EQ. 1) GO TO 100
   K = 1
 6 IF (K .GT. I/2) GO TO 100
   TI = A(K)
   TJ = A(I-K)
   A(K) = TI + R(I)*TJ
   A(I-K) = TJ + R(I)*TI
   K = K + 1
   GO TO 6

100 CONTINUE

        COMPUTE PREDICTION ERROR
```

```
      PE=0
      DO 1610 N = 161,240

       DN = S(N)
       L = N - 1

        DO 10 I = 1, 10
        DN = DN + A(I)*S(L)
  10    L = L - 1

 1610 PE=PE+DN*DN

      RETURN
      END

           COMPUTE INNER PRODUCT
      SUBROUTINE INPROD(S,Y,N,PS)
      DIMENSION Y(N),S(N)
      PS = 0.0
      DO 1 I = 1,N
    1 PS = PS + S(I)*Y(I)
      RETURN
      END
```

APPENDIX 2

```
           PITCH ANALYSIS - MAIN PROGRAM
                SUBROUTINE
           NEEDS SUBROUTINES - LPFILT PITCHP
                               MOVE INPROD
                               CPSTRM SELMAX
                               INTRPL NORMEQ

      SUBROUTINE PITCH

      COMMON/BLKSIG/S(320),SP(80)
      COMMON/BLKPAR/LPEAK,RMS,VUV,RC(10),AC(10),PS,PE

      LOGICAL INIT
      DATA INIT/T/

      IF(.NOT.INIT)GOTO100
            SET UP 1-KHZ LOWPASS FILTER
            COEFFICIENTS
            FOR FILTERING SPEECH AND CEPSTRUM
      CALL LPFILT(HL,666,333)
      CALL LPFILT(HT,0,1000)
      INIT=.F.

  100 CONTINUE

           LOW-PASS FILTER SPEECH TO 1 KHZ AND
                STORE IN SP

      N=321
      DO3I=61,80
      CALL INPROD(S(N-48),HL,48,SP(I))
```

```
3 N=N+4
        COMPUTE PITCH PERIOD
  CALL PITCHP

        COMPUTE RMS VALUE
  SM=0
  DO4I=161-LPEAK,161
4 SM=SM+S(I)**2
  RMS=SQRT(SM/LPEAK)

        MOVE SPEECH SAMPLES FOR PROCESSING
             IN THE NEXT INTERVAL
  CALL MOVE(S(81),S,240)
  CALL MOVE(SP(21),SP,60)

  RETURN
  END

        FIND PITCH PERIOD BY CEPSTRAL PEAK
             PICKING
  SUBROUTINE PITCHP

  COMMON/BLKSIG/S(329),SP(80)
  COMMON/BLKPAR/LPEAK,RMS,VUV,RC(10),A(10),PS,PE
  COMMON/BLKLPF/H(48),HR(16)
  DIMENSION P(31),C(31)
  COMMON/BLKSCR/R(32)

        COMPUTE AUTOCORRELATION FUNCTION OF
             SPEECH
  DO11I=1,32
11 CALL INPROD(SP,SP(I),81-I,R(I))
  DO3I=2,32
3 R(I)=R(I)/R(1)
  R(1)=1

        COMPUTE PREDICTOR COEFFICIENTS
  CALL NORMEQ(R(2),P,31,C)
  CON=0.97
  FAC=CON
  DO 125 K=2,32
  P(K)=FAC*P(K)
125 FAC=FAC*CON

        COMPUTE CEPSTRUM
  CALL CPSTRM(P,(32),C,(32))

        LOCATE TWO LARGEST PEAKS OF CEPSTRUM
  L=1
  CALL SELMAX(C(L+1),(31-L),XM1,LM1)
20 IF(XM1.GT.0.) GOTO 10
  LPEAK=1

  RETURN

10 LM1=LM1+L
  XM2=0.
  LM2=0
```

```
      DO 1 I=L+1,32
      IF(C(I).LE.0.) GOTO 1
      IF(I.EQ.LM1) GOTO 1
      IF(C(I).GT.C(I-1).AND.C(I).GT.C(I+1)) GOTO 2
      GOTO 1
    2 IF(C(I).LE.XM2) GOTO 1
      XM2=C(I)
      LM2=I
    1 CONTINUE

          INTERPOLATE TRUE VALUES OF CEPSTRAL
                PEAKS
  300 CALL INTRPL(C,32,H,16,4,XM1,LM1)
      CALL INTRPL(C,32,H,16,4,XM2,LM)
      IF(LM1.LT.LM.AND.XM1.GE.XM2) GOTO 200
      IF(XM1.GE.XM2) GOTO 150

          SELECT THE TRUE PEAK
  250 XX=XM2
      LX=LM2
      LM2=LM1
      XM2=XM1
      XM1=XX
      LM1=LX
  150 IF(LM1.LT.LM) GOTO 200
      IF(XM1.GE.(2.*XM2)) GOTO 200
      LMH=LM1/2
      IF(IABS(IM-LMH).GT.2) GOTO 200
      GOTO 250

          STORE PITCH IN LPEAK
  200 CONTINUE
      LPEAK=LM1

      RETURN
      END

          COMPUTE PREDICTOR COEFFICIENTS FROM
                AUTOCORRELATIONS
      SUBROUTINE NORMEQ(A,X,N,T)
      DIMENSION A(1),X(1),T(1)

      M=N
      DO5I=1,M
      X(I+1)=0
    5 T(I)=0

      X(1)=1.
      X(2)=-A(1)
      T(1)=-A(1)

      DO 3 I=2,N
      S1=A(I)
      S2=1.
      DO 4 J=1,I-1
      S1=S1+A(I-J)*X(J+1)
    4 S2=S2+A(J)*X(J+1)
      IF(S2.LE.(1.OE-7)) RETURN
```

```
      M=I
      RC=-S1/S2
      T(I)=RC
      X(I+1)=RC
      DO 1 J=1,I/2
      TI=X(J+1)
      TJ=X(I-J+1)
      X(J+1)=TI+RC*TJ
    1 X(I-J+1)=TI*RC+TJ
    3 CONTINUE

      RETURN
      END

          TRANSFORM POLYNOMIAL COEFFICIENTS BY
                NEWTON FORMULA
      SUBROUTINE CPSTRM(P,LP,S,LS)
      DIMENSION P(LP),S(LS)

      S(1)=1.
      NP=LP-1
      XN=1./NP
      S(2)=-P(2)*XN
      IF(LS.LE.2) RETURN

      DO 1 M=3,LS
      SM=0.
      IF(M.LE.LP) SM=-(M-1)*P(M)*XN
      JJ86AA=MIN0((M-2),NP)
      DO 2 K=1,JJ86AA
    2 SM=SM-P(K+1)*S(M-K)
    1 S(M)=SM

      RETURN
      END

          SELECT MAXIMUM VALUE
      SUBROUTINE SELMAX(X,LX,SM,LM)
      DIMENSION X(LX)

      B=-1.0E+37
      DO 2 I=1,LX
      IF(X(I).LT.B) GOTO 2
      B=X(I)
      LL=I
    2 CONTINUE
  100 LM=LL
      XM=B
      RETURN
      END

          FIND PEAK AFTER INTERPOLATION
      SUBROUTINE INTRPL(C,LC,H,IH,IR,XM,LM)
      DIMENSION C(LC),H(LH),T(30)

      L=LH/2
      K1=(LM-2.0)*IR+1
      K2=(LM)*IR+1.5
```

```
      K2=MIN0(K2,(LC*IR-L))
540   DO 100 K=K1,K2
      KL=K+L
      N=(KL-1)/IR+1
      KK=KL-(N-1)*IR
      CI=H(KK)*C(N)
    2 N=N-1
      KK=KK+IR
      IF(KK.GT.LH) GOTO 100
      CI=CI+H(KK)*C(N)
      GOTO 2
100   T(K-K1+1)=CI

      CALL SELMAX(T,(K2-K1+1),XM,LM)
405   LM=LM+K1-2

      RETURN
      END

          GENERATE COEFFICIENTS OF A LOW-PASS
                FILTER
      SUBROUTINE LPFILT(H,FO,DF)
      DIMENSION H(1)

      PI=3.1415926539
      MM=16000/DF+0.5
      T=-1/DF
      M=1
      TI=T
      NSIN=FO/(0.5*DF)+0.5

100   HW=0.54+0.46*COS(PI*DF*T)

      HC=0.5
      F=FO
      F=F+DF*0.5
      L=1
   11 IF(L.GT.NSIN)GOTO12
      HC=HC+COS(2*PI*F*T)
      L=L+1
      F=F+DF*0.5
      GOTO11
   12 H(M)=HW*HC
      IF(M.GE.MM)GOTO300
      T=M*0.000125+TI
      M=M+1
      GOTO100

300   SM=0.
      PFM=PI*(FO)
      DO 31 I=1,M
      SM=SM + H(I)*COS(PFM*((I-1)*0.000125+TI))
   31 CONTINUE
      DO 3 I=1,M
    3 H(I)=H(I)/SM

      RETURN
      END
```

```
      MOVE AN ARRAY
  SUBROUTINE MOVE (X,Y,N)
  DIMENSION X(N),Y(N)

  DO1I=1,N
1 Y(I)=X(I)

  RETURN
  END

      COMPUTE INNER PRODUCT
  SUBROUTINE INPROD(S,Y,N,PS)
  DIMENSION Y(N),S(N)
  PS = 0.0
  DO 1 I = 1,N
1 PS = PS + S(I)*Y(I)
  RETURN
  END
```

APPENDIX 3

```
      VOICED-UNVOICED ANALYSIS - MAIN
      SUBROUTINE PROGRAM
      NEEDS 3 SUBROUTINES - VUVDEC VUVPAR ZERCRS

  SUBROUTINE VUVANL

  COMMON/BLKSIG/S(320),SP(80)
  COMMON/BLKPAR/LPEAK,RMS,VUV,R(10),A(10),PS,PE

  CALL VUVDEC
  RMS=SQRT(PS/80)

  RETURN
  END

      VOICED-UNVOICED DECISION BY LIN PRED
  SUBROUTINE VUVDEC

  COMMON/BLKSIG/S(320),SP(80)
  COMMON/BLKPAR/LPEAK,RMS,VUV,R(10),A(10),PS,PE
  INTEGER VUV
  COMMON/BLKWTS/W(5,5,2),U(5,2),SD(5,2)
  DIMENSION Q(5),C(5),T(6),D(5)

      COMPUTE VOICED-UNVOICED PARAMETERS
      Q = PARAMETERS
  CALL VUVPAR(Q)

      VOICED-UNVOICED-SILENCE DECISION
  DO 20 K=1,2
  DO 21 I=1,5
21 C(I)=(Q(I)-U(I,K))/SD(I,K)
  D(K)=0
  DO 22 I=1,5
  DO 22 J=1,5
22 D(K)=D(K)+W(I,J,K)*C(I)*C(J)
  D(K)=-D(K)
```

```
20 CONTINUE
   IF(D(1).GT.D(2)) VUV=0
   IF(D(1).LE.D(2)) VUV=1

   RETURN
   END

        COMPUTE PARAMETERS FOR VUVDEC
   SUBROUTINE VUVPAR (Q)

   DIMENSION Q(5)
   COMMON/BLKSIG/S(320),SP(80)
   COMMON/BLKPAR/LPEAK,RMS,VUV,R(10),A(10),PS,PE
        COMPUTE PARAMETERS - Q(1) ..... Q(5)
        NZER = NUMBER OF ZERO CROSSINGS
        PS = SPEECH ENERGY - PE = PREDICTION
        ERROR ENERGY
        A(1) = FIRST PREDICTOR COEFF - R(1) =
        FIRST CORRELATION
   CALL ZERCRS(S,161,240,NZER)
   Q(1)=NZER
   Q(3)=10.*ALOG10(1.0E-5+PS*0.0125)
   Q(2)=Q(3)-10.*ALOG10(1.0E-6+0.0125*PE)
   Q(4)=A(1)
   Q(5)=R(1)

   RETURN
   END
        COMPUTE ZEROCROSSINGS FOR
        UNVOICED/VOICED DECISION
   SUBROUTINE ZERCRS (S,LP,NS,NZER)
   DIMENSION S(1)

   NZER=0
   SPREV=S(LP-1)
   DO 1 K=LP,NS
   SPRES=S(K)
   IF(SPRES.LT.0..AND.SPREV.LT.0.) GOTO 1
   IF(SPRES.GT.0..AND.SPREV.GT.0.) GOTO 1
   NZER=NZER+1
 1 SPREV=SPRES

   RETURN
   END
```

E. S. Atal 7

I claim:

1. A speech communication circuit comprising:

a speech analyzer including means for partitioning an input speech signal into time intervals;

means responsive to the speech signal of each interval for generating a set of first signals representative of the prediction parameters of said interval speech signal, a pitch representative signal and a voicing representative signal;

and means jointly responsive to said interval speech signal and said interval first signals for generating a signal corresponding to the prediction error of the interval;

and a speech synthesizer including an excitation generator responsive to said pitch and voicing representative signals for producing an excitation signal;

and means jointly responsive to said excitation signal and said first signals for constructing a replica of said input speech signal;

characterized in that said speech analyzer further includes means (124, 126) responsive to said prediction error signal for generating a set of second signals representative of the spectrum of the interval prediction error signal; and said synthesizer excitation generator (220) is jointly responsive to said pitch representative, voicing representative and second signals to produce a prediction error compensating excitation signal.

2. A speech communication circuit according to claim 1 further characterized in that said synthesizer excitation generator (220) comprises means (618) jointly responsive to the pitch and voicing representative signals for generating a first excitation signal and means (650) responsive to said second signals for shaping said first excitation signal to form said prediction error compensating excitation signal.

3. A speech communication circuit according to claim 2 further characterized in that said first excitation signal producing means (618) comprises means (620, 622, 624) jointly responsive to said pitch and voicing representative signal for generating a sequence of excitation pulses and said first excitation signal shaping means (650) comprises means (601, 603, 610) responsive to said second signals for modifying said excitation pulses to form a sequence of prediction error compensating excitation pulses.

4. A speech communication circuit according to claim 3 further characterized in that said second signal generating means (124, 126) comprises means (504) responsive to the interval prediction error signal for forming a plurality of prediction error spectral signals each for a predetermined frequency; and means (513) for sampling said interval prediction error spectral signals during said interval to produce said second signals.

5. A speech communication system according to claim 4 further characterized in that said excitation pulse modifying means (601, 603, 610) comprises means (603) responsive to said first excitation pulses for forming a plurality of excitation spectral component signals corresponding to said predetermined frequencies; means (601) jointly responsive to said pitch representative signal and said second signals for generating a plurality of prediction error spectral coefficient signals corresponding to said predetermined frequencies; and means (610) for combining said excitation spectral component signals with said prediction error spectral coefficient signals to form said prediction error compensating excitation pulses.

6. A method for processing a speech signal comprising the steps of:

analyzing said speech signal including partitioning the speech signal into successive time intervals, generating a set of first signals representative of the prediction parameters of said interval speech signal, a pitch representative signal, and a voicing representative signal, responsive to the speech signal of each interval; and generating a signal corresponding to the prediction error of said speech interval jointly responsive to the interval speech signal and the first signals of the interval; and synthesizing a replica of said speech signal including producing an excitation signal responsive to said pitch and voicing representative signals and constructing a replica of said speech signal jointly responsive to said excitation signal and said first signals characterized in that said speech analyzing step further includes generating a set of second signals representative of the spectrum of the interval prediction error signal responsive to said prediction error signal; and said excitation signal producing step includes forming a prediction error compensating excitation signal jointly responsive to said pitch representative signal, said voicing representative signal and said second signals.

7. A method for processing a speech signal according to claim 6 further characterized in that said prediction error compensating excitation signal forming step comprises generating a first excitation signal responsive to said pitch representative and voicing representative signals; and shaping first excitation signal responsive to said second signals to form said prediction error compensating excitation signal.

8. A method for processing a speech signal according to claim 7 further characterized in that the producing of said first excitation signal includes generating a sequence of excitation pulses jointly responsive to said pitch and voicing representative signals; and the shaping of said first excitation signal includes modifying the excitation pulses responsive to said second signals to form a sequence of prediction error compensating excitation pulses.

9. A method for processing a speech signal according to claim 8 further characterized in that said second signal generating step comprises forming a plurality of prediction error spectral signals, each for a predetermined frequency, responsive to the interval prediction error signal; and sampling said interval prediction error spectral signals during the interval to produce said second signals.

10. A method for processing a speech signal according to claim 9 further characterized in that the modification of said excitation pulses comprises forming a plurality of excitation spectral component signals corresponding to said predetermined frequencies responsive to said first excitation pulses; and generating a plurality of prediction error spectral coefficient signals corresponding to said predetermined frequencies jointly responsive to said pitch representative signal and said second signals, and combining said excitation spectral component signals with said prediction error spectral coefficient signals to form said prediction error compensating excitation pulses.

* * * * *

UNITED STATES PATENT AND TRADEMARK OFFICE

CERTIFICATE OF CORRECTION

PATENT NO. : 4,220,819

DATED : September 2, 1980

INVENTOR(S) : Bishnu S. Atal

It is certified that error appears in the above—identified patent and that said Letters Patent is hereby corrected as shown below:

Column 1, line 14, "bandwith" should read --bandwidth--; line 38, "then" should read --than--. Column 3, line 18, "DE" should be on line 19; line 19, "DETAILED DESCRIPTION" should be centered. Column 4, line 58, "$C_1$" should read --$c_1$--. Column 7, line 65, "contructed" should read --constructed--. Column 9, line 14, that portion of the formula reading "$(\tau_i/P)$" should read --$\tau_i/P$--. Column 10, line 6, "frquency" should read --frequency--. Column 25, just before "I claim" omit "B. S. Atal 7".

Signed and Sealed this

*Third* Day of *February 1981*

[SEAL]

*Attest:*

RENE D. TEGTMEYER

*Attesting Officer*

*Acting Commissioner of Patents and Trademarks*